US009717374B1

(12) United States Patent
Kinsale

(10) Patent No.: US 9,717,374 B1
(45) Date of Patent: Aug. 1, 2017

(54) BODILY SCRUBBING ASSEMBLY

(71) Applicant: Anderson Kinsale, Brooklyn, NY (US)

(72) Inventor: Anderson Kinsale, Brooklyn, NY (US)

( * ) Notice: Subject to any disclaimer, the term of this patent is extended or adjusted under 35 U.S.C. 154(b) by 0 days.

(21) Appl. No.: 15/040,524

(22) Filed: Feb. 10, 2016

(51) Int. Cl.
*A47K 7/03* (2006.01)
*A47K 7/02* (2006.01)

(52) U.S. Cl.
CPC ..... *A47K 7/024* (2013.01)

(58) Field of Classification Search
CPC ..... A47K 7/02; A47K 7/024
See application file for complete search history.

(56) References Cited

U.S. PATENT DOCUMENTS

| | | | | |
|---|---|---|---|---|
| 3,612,044 | A | 10/1971 | Gurrola | |
| 4,053,960 | A | 10/1977 | Kingswell | |
| 4,704,759 | A | 11/1987 | Mesa | |
| 5,228,165 | A | 7/1993 | Westberry et al. | |
| D344,633 | S | 3/1994 | Ali | |
| 6,053,464 | A * | 4/2000 | Cardarelli | F16B 47/00 248/205.8 |
| D444,916 | S | 7/2001 | Brown, Sr. | |
| 6,526,618 | B1 | 3/2003 | Bolton | |
| 6,647,564 | B1 * | 11/2003 | Smith | A47K 7/024 15/176.5 |

* cited by examiner

*Primary Examiner* — Shay Karls

(57) ABSTRACT

A bodily scrubbing assembly includes a housing that may be removably coupled to a wall in a shower. A sponge is removably positioned in the housing. Thus, the sponge is retained on the shower thereby facilitating the sponge to scrub a user's body. A plurality of couplers is provided and each of the couplers is coupled to the sponge. Each of the couplers engages the housing such that the sponge is removably retained in the housing.

8 Claims, 5 Drawing Sheets

16
14
44
56
34

BODILY SCRUBBING ASSEMBLY

BACKGROUND OF THE DISCLOSURE

Field of the Disclosure

The disclosure relates to scrubbing devices and more particularly pertains to a new scrubbing device for scrubbing a user's back in a shower.

SUMMARY OF THE DISCLOSURE

An embodiment of the disclosure meets the needs presented above by generally comprising a housing that may be removably coupled to a wall in a shower. A sponge is removably positioned in the housing. Thus, the sponge is retained on the shower thereby facilitating the sponge to scrub a user's body. A plurality of couplers is provided and each of the couplers is coupled to the sponge. Each of the couplers engages the housing such that the sponge is removably retained in the housing.

There has thus been outlined, rather broadly, the more important features of the disclosure in order that the detailed description thereof that follows may be better understood, and in order that the present contribution to the art may be better appreciated. There are additional features of the disclosure that will be described hereinafter and which will form the subject matter of the claims appended hereto.

The objects of the disclosure, along with the various features of novelty which characterize the disclosure, are pointed out with particularity in the claims annexed to and forming a part of this disclosure.

BRIEF DESCRIPTION OF THE DRAWINGS

The disclosure will be better understood and objects other than those set forth above will become apparent when consideration is given to the following detailed description thereof. Such description makes reference to the annexed drawings wherein.

DESCRIPTION OF THE PREFERRED EMBODIMENT

Figure 1:
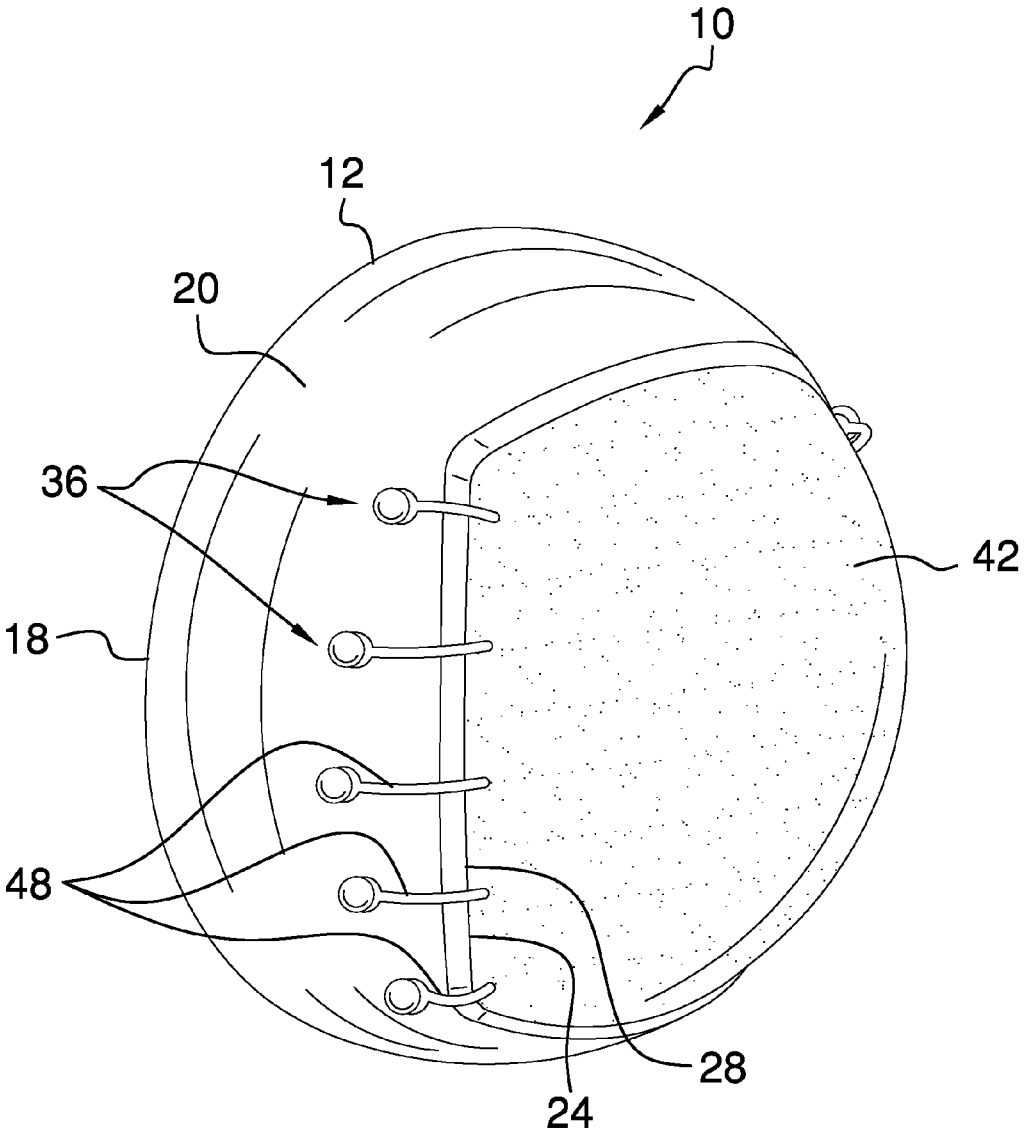
FIG. 1 is a perspective view of a bodily scrubbing assembly according to an embodiment of the disclosure.
Figure 2:
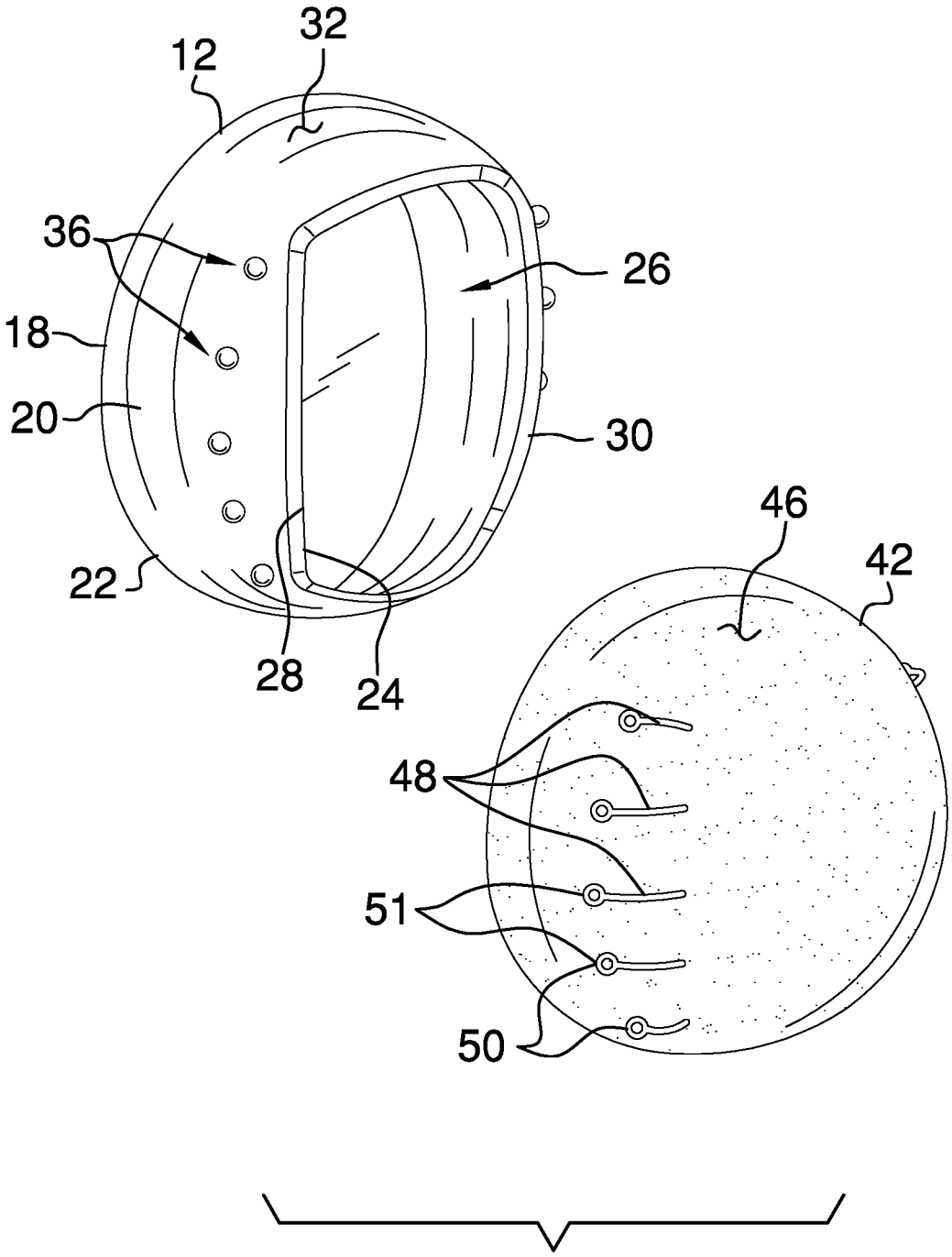
FIG. 2 is an exploded perspective view of an embodiment of the disclosure.
Figure 3:
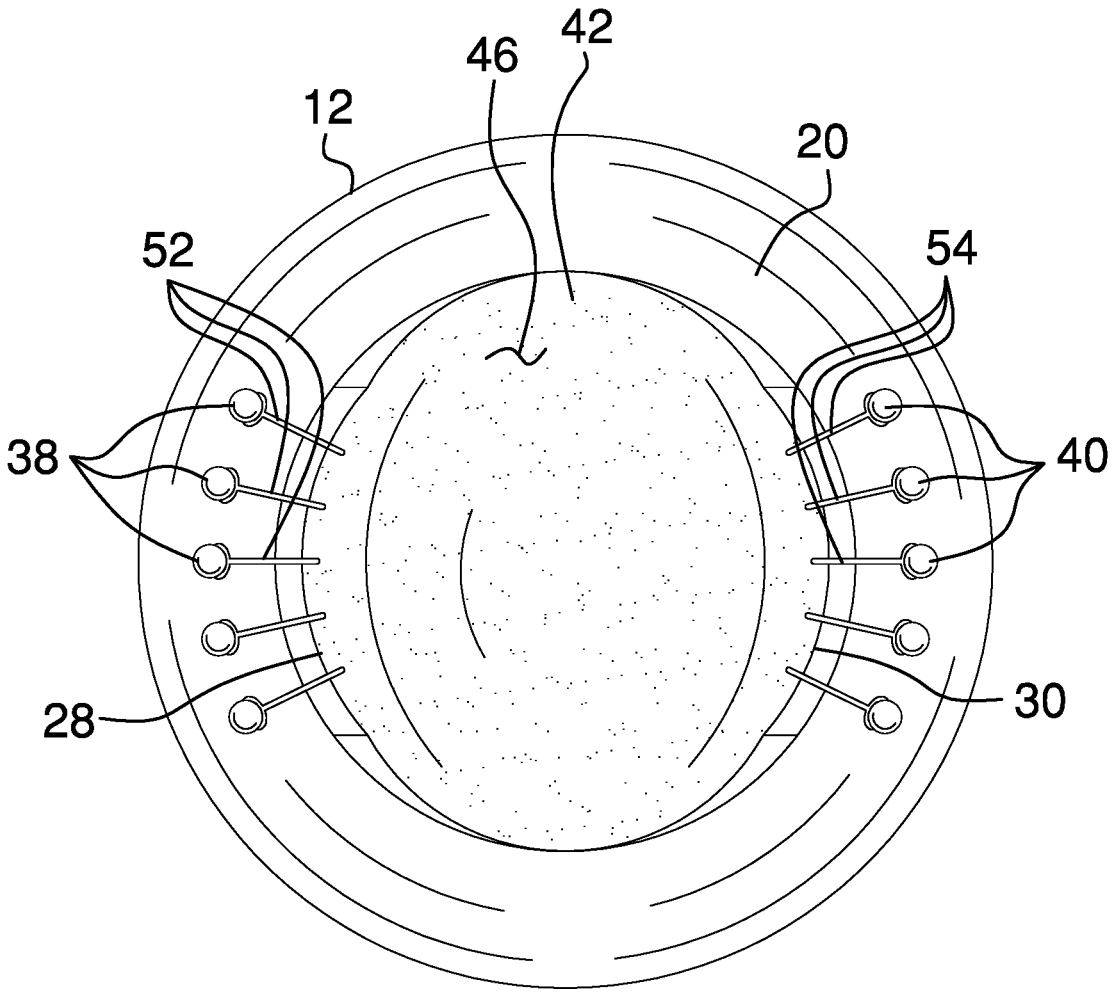
FIG. 3 is a front view of an embodiment of the disclosure.
Figure 4:
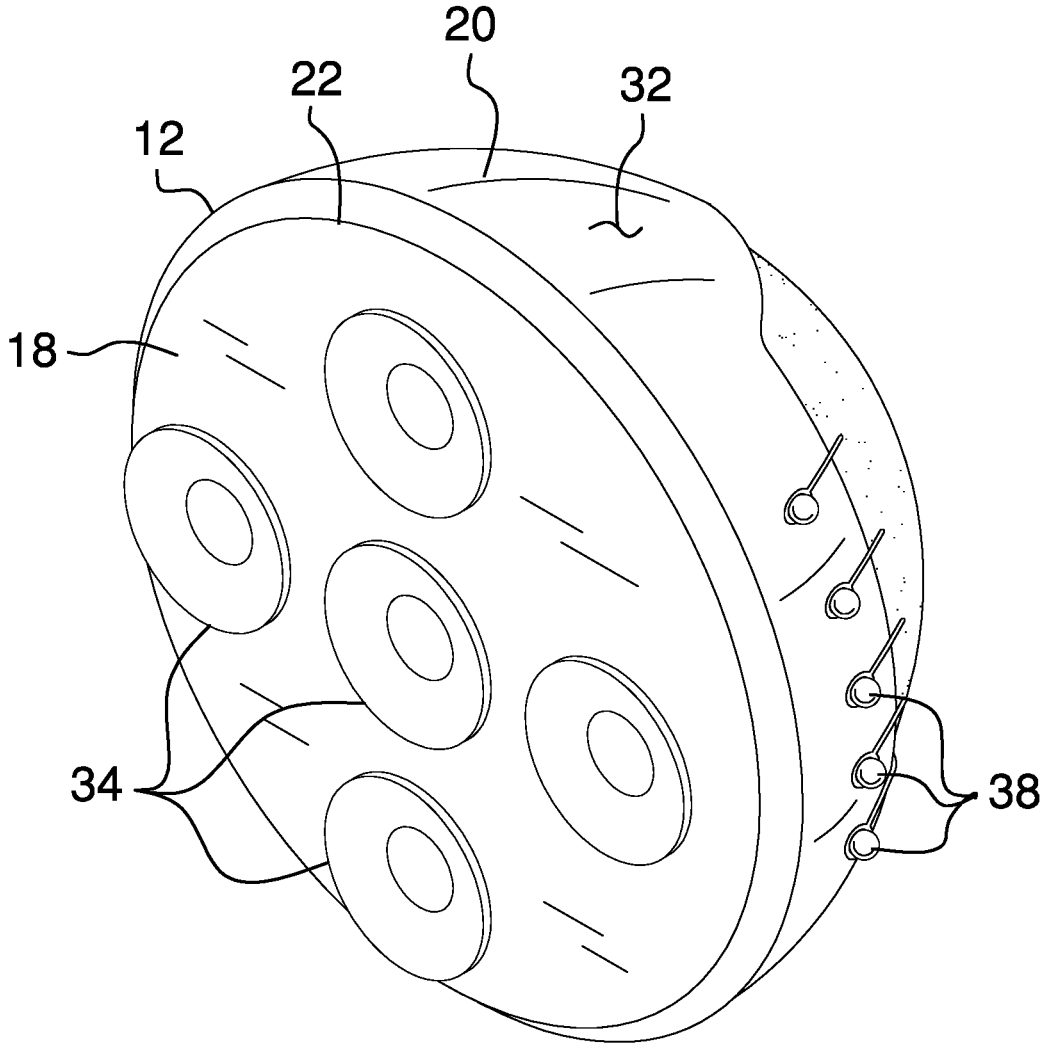
FIG. 4 is a back perspective view of an embodiment of the disclosure.
Figure 5:
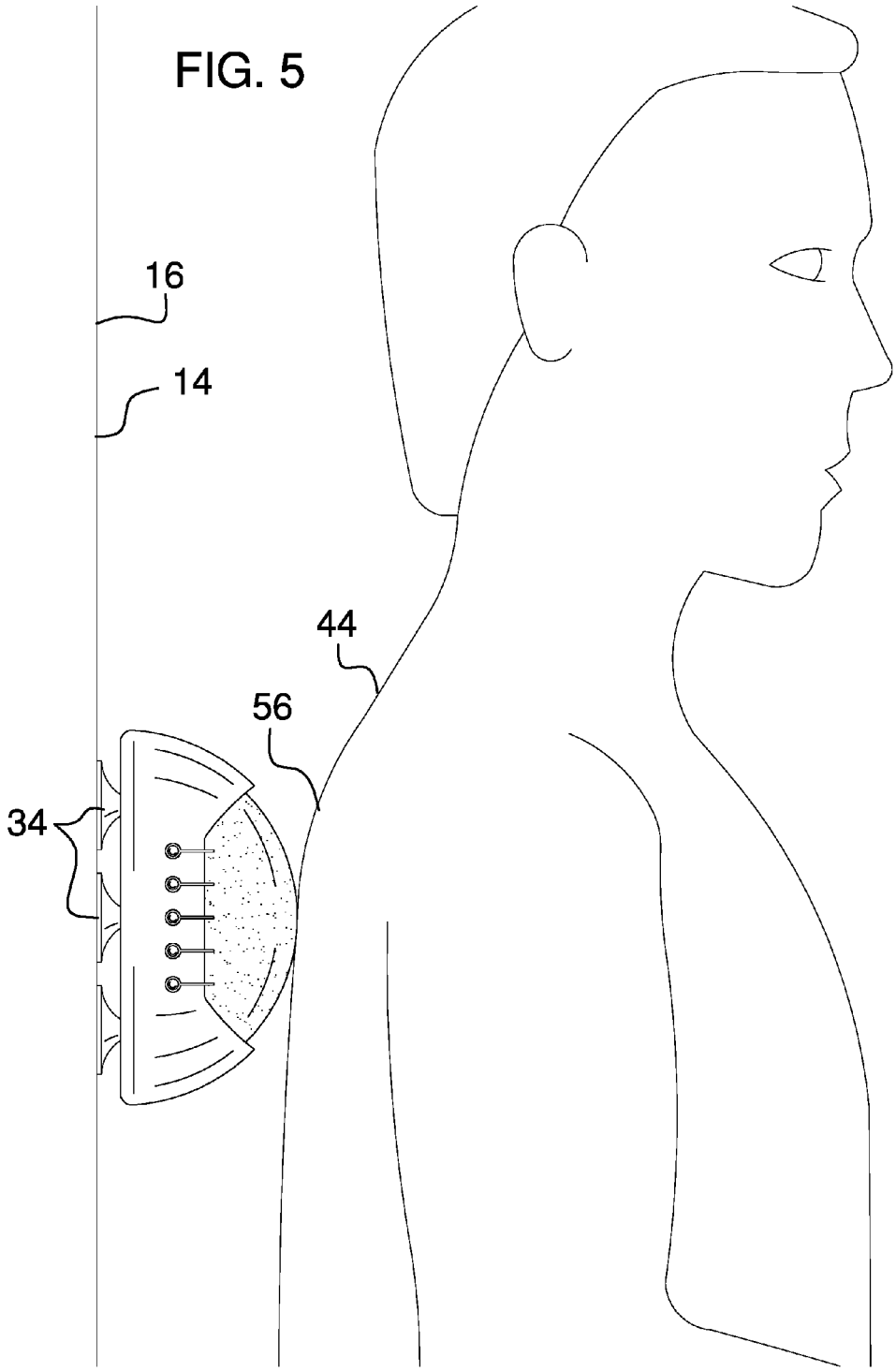
FIG. 5 is a perspective in-use view of an embodiment of the disclosure.

With reference now to the drawings, and in particular to FIGS. 1 through 5 thereof, a new scrubbing device embodying the principles and concepts of an embodiment of the disclosure and generally designated by the reference numeral 10 will be described.

As best illustrated in FIGS. 1 through 5, the bodily scrubbing assembly 10 generally comprises a housing 12 that may be removably coupled to a wall 14 in a shower 16. The shower 16 may be a shower in a bathroom or the like. The housing 12 has a back wall 18 and a peripheral wall 20 extending away from the back wall 18. The peripheral wall 20 is coextensive with an outer edge 22 of the back wall 18. The outer edge 22 is continuous such that the back wall 18 has a circular shape.

The peripheral wall 20 is continuous such that the housing 12 has a substantially hemispherical shape. The peripheral wall 20 has a distal edge 24 with respect to the back wall 18. The distal edge 24 defines an opening 26 extending into an interior of the housing 12. The distal edge 24 has a first lateral side 28 and a second lateral side 30. The peripheral wall 20 has an outer surface 32. The housing 12 may be comprised of a fluid impermeable material.

A plurality of fasteners 34 is provided. Each of the fasteners 34 is coupled to the back wall 18. The fasteners 34 are spaced apart from each other and are distributed on the back wall 18. Each of the fasteners 34 engages the wall 14 in the shower 16 such that the housing 12 is removably retained on the shower 16. Each of the fasteners 34 may comprise a suction cup or the like.

A plurality of balls 36 is provided and each of the balls 36 is coupled to the housing 12. Each of the balls 36 is positioned on the outer surface 32 of the housing 12. The plurality of balls 36 includes a set of first balls 38. The first balls 38 are spaced apart from each other and are distributed along the first lateral side 28 of the distal edge 24. The plurality of balls 36 includes a set of second balls 40. The second balls 40 are spaced apart from each other and are distributed along the second lateral side 30 of the distal edge 24.

A sponge 42 is removably positioned in the housing 12. Thus, the sponge 42 may be retained on the shower 16 thereby facilitating the sponge 42 to scrub a user's body 44. The sponge 42 has an exterior surface 46. The exterior surface 46 is continuous such the sponge 42 is substantially spherical. The sponge 42 is extended into through the opening 26 such that the sponge 42 is retained in the interior of the housing 12. The sponge 42 extends outwardly from the opening 26. Thus, the exterior surface 46 may frictionally engage the user's body 44.

A plurality of couplers 48 is provided and each of the couplers 48 is coupled to the sponge 42. Each of the couplers 48 may be manipulated to engage the housing 12 such that the sponge 42 is removably retained in the housing 12. Each of the couplers 48 is positioned on the exterior surface 46. Each of the couplers 48 has a distal end 50 with respect to the exterior surface 46. The distal end 50 corresponding to each of the couplers 48 forms a closed ring 51. Each of the plurality of couplers 48 may be comprised of a resiliently stretchable material.

The plurality of couplers 48 comprises a set of first couplers 52. The first couplers 52 are spaced apart from each other and are distributed along the exterior surface 46. Each of the first couplers 52 is aligned with an associated one of the first balls 38 when the sponge 42 is positioned in the housing 12. The distal end 50 corresponding to the first couplers 52 engages the associated first ball 38. Thus, the sponge 42 is removably retained in the housing 12.

The plurality of couplers 48 further comprises a set of second couplers 54. The second couplers 54 are spaced apart from each other and are distributed along the exterior surface 46. Each of the second couplers 54 is aligned with an associated one of the second balls 40 when the sponge 42 is positioned in the housing 12. The distal end 50 corresponding to the second couplers 54 engage the associated second ball 40. Thus, the sponge 42 is removably retained in the housing 12. The sponge 42 may comprise a synthetic sponge or the like.

In use, the housing 12 is coupled to the wall 14 in the shower 16. The sponge 42 is positioned in the housing 12. Each of the first couplers 52 is attached to the associated first ball 38. Each of the second couplers 54 is attached to the associated second ball 56. The user body 44 leans against the sponge 42 while the user bathes. Thus, the sponge 42 scrubs and cleans the user's back 56.

With respect to the above description then, it is to be realized that the optimum dimensional relationships for the parts of an embodiment enabled by the disclosure, to include variations in size, materials, shape, form, function and manner of operation, assembly and use, are deemed readily apparent and obvious to one skilled in the art, and all equivalent relationships to those illustrated in the drawings and described in the specification are intended to be encompassed by an embodiment of the disclosure.

Therefore, the foregoing is considered as illustrative only of the principles of the disclosure. Further, since numerous modifications and changes will readily occur to those skilled in the art, it is not desired to limit the disclosure to the exact construction and operation shown and described, and accordingly, all suitable modifications and equivalents may be resorted to, falling within the scope of the disclosure. In this patent document, the word "comprising" is used in its non-limiting sense to mean that items following the word are included, but items not specifically mentioned are not excluded. A reference to an element by the indefinite article "a" does not exclude the possibility that more than one of the element is present, unless the context clearly requires that there be only one of the elements.

I claim:

1. A bodily scrubbing assembly comprising:

a housing being configured to be removably coupled to a wall in a shower;

a sponge being removably positioned in said housing wherein said sponge is configured to be retained on the shower thereby facilitating said sponge to scrub a user's body; and a plurality of couplers, each of said couplers being coupled to said sponge wherein each of said couplers is configured to be manipulated, each of said couplers engaging said housing such that said sponge is removably retained in said housing; and wherein said housing has a back wall and a peripheral wall extending away from said back wall, said peripheral wall being coextensive with an outer edge of said back wall, said outer edge being continuous such that said back wall has a circular shape, said peripheral wall being continuous such that said housing has a substantially hemispherical shape, said peripheral wall having a distal edge with respect to said back wall, said distal edge defining an opening extending into an interior of said housing, said distal edge having a first lateral side and a second lateral side, said peripheral wall having an outer surface.

2. The assembly according to claim 1, further comprising a plurality of balls, each of said balls being coupled to said housing, each of said balls being positioned on said outer surface of said housing.

3. The assembly according to claim 2, wherein said plurality of balls comprises:

a set of first balls, each of said first balls being spaced apart from each other and being distributed along said first lateral side of said distal edge, and a set of second balls, each of said second balls being spaced apart from each other and being distributed along said second lateral side of said distal edge.

4. The assembly according to claim 1, wherein:

said housing has an opening extending into an interior of said housing; and said sponge has an exterior surface, said exterior surface being continuous such said sponge is substantially spherical, said sponge being extended into through said opening such that said sponge is retained in said interior of said housing, said sponge extending outwardly from said opening wherein said exterior surface is configured to frictionally engage the user's body.

5. The assembly according to claim 4, wherein each of said couplers being positioned on said exterior surface, each of said couplers having a distal end with respect to said exterior surface, said distal end corresponding to each of said couplers forming a closed ring.

6. A bodily scrubbing assembly comprising:

a housing being configured to be removably coupled to a wall in a shower, said housing having an opening extending into an interior of said housing;

a sponge being removably positioned in said housing wherein said sponge is configured to be retained on the shower thereby facilitating said sponge to scrub a user's body, said sponge having an exterior surface, said exterior surface being continuous such that said sponge is substantially spherical, said sponge being extended into said housing through said opening such that said sponge is retained in said interior of said housing, said sponge extending outwardly from said opening wherein said exterior surface is configured to frictionally engage the user's body;

a plurality of couplers, each of said couplers being coupled to said sponge wherein each of said couplers is configured to be manipulated, each of said couplers engaging said housing such that said sponge is removably retained in said housing, wherein each of said couplers is positioned on said exterior surface, each of said couplers having a distal end with respect to said exterior surface, said distal end corresponding to each of said couplers forming a closed ring;

said housing includes a plurality of first balls; and said plurality of couplers comprises a set of first couplers, said first couplers being spaced apart from each other and being distributed along said exterior surface, each of said first couplers being aligned with an associated one of said first balls when said sponge is positioned in said housing, said distal end corresponding to said first couplers engaging said associated first ball such that said sponge is removably retained in said housing.

7. The assembly according to claim 6, wherein:

said housing includes a plurality of second balls; and a set of second couplers, said second couplers being spaced apart from each other and being distributed along said exterior surface, each of said second couplers being aligned with an associated one of said second balls when said sponge is positioned in said housing, said distal end corresponding to said second couplers engaging said associated second ball such that said sponge is removably retained in said housing.

8. A bodily scrubbing assembly comprising:

a housing being configured to be removably coupled to a wall in a shower, said housing having a back wall and a peripheral wall extending away from said back wall, said peripheral wall being coextensive with an outer edge of said back wall, said outer edge being continuous such that said back wall has a circular shape, said peripheral wall being continuous such that said housing has a substantially hemispherical shape, said peripheral wall having a distal edge with respect to said back wall, said distal edge defining an opening extending into an interior of said housing, said distal edge having a first lateral side and a second lateral side, said peripheral wall having an outer surface;

a plurality of fasteners, each of said fasteners being coupled to said back wall, each of said fasteners being configured to engage the wall in the shower such that said housing is removably retained on the shower;

a plurality of balls, each of said balls being coupled to said housing, each of said balls being positioned on said outer surface of said housing, said plurality of balls comprising:

a set of first balls, each of said first balls being spaced apart from each other and being distributed along said first lateral side of said distal edge, and a set of second balls, each of said second balls being spaced apart from each other and being distributed along said second lateral side of said distal edge;

a sponge being removably positioned in said housing wherein said sponge is configured to be retained on the shower thereby facilitating said sponge to scrub a user's body, said sponge having an exterior surface, said exterior surface being continuous such said sponge is substantially spherical, said sponge being extended into through said opening such that said sponge is retained in said interior of said housing, said sponge extending outwardly from said opening wherein said exterior surface is configured to frictionally engage the user's body; and a plurality of couplers, each of said couplers being coupled to said sponge wherein each of said couplers is configured to be manipulated, each of said couplers engaging said housing such that said sponge is removably retained in said housing, each of said couplers being positioned on said exterior surface, each of said couplers having a distal end with respect to said exterior surface, said distal end corresponding to each of said couplers forming a closed ring, said plurality of couplers comprising:

a set of first couplers, said first couplers being spaced apart from each other and being distributed along said exterior surface, each of said first couplers being aligned with an associated one of said first balls when said sponge is positioned in said housing, said distal end corresponding to said first couplers engaging said associated first ball such that said sponge is removably retained in said housing; and a set of second couplers, said second couplers being spaced apart from each other and being distributed along said exterior surface, each of said second couplers being aligned with an associated one of said second balls when said sponge is positioned in said housing, said distal end corresponding to said second couplers engaging said associated second ball such that said sponge is removably retained in said housing.

* * * * *